US005544576A

United States Patent [19]

Kato

[11] Patent Number: 5,544,576

[45] Date of Patent: Aug. 13, 1996

[54] MECHANICAL PRESSING MACHINE HAVING A LOAD FLUCTUATING TORQUE CANCELLING DEVICE

[75] Inventor: Heizaburo Kato, Shizuoka-ken, Japan

[73] Assignee: Sankyo Seisakusho Co., Tokyo, Japan

[21] Appl. No.: 328,464

[22] Filed: Oct. 25, 1994

[30] Foreign Application Priority Data

Oct. 26, 1993 [JP] Japan ..... 5-267289

[51] Int. Cl.[6] ..... B30B 1/06

[52] U.S. Cl. ..... 100/35; 83/615; 100/259; 100/282; 100/292

[58] Field of Search ..... 100/214, 259, 100/280, 282, 292, 35; 72/429, 451, 452; 74/49, 55, 589–591, 603, 604; 83/615, 628

[56] References Cited

U.S. PATENT DOCUMENTS

| | | | |
|---|---|---|---|
| 2,857,157 | 10/1958 | Bonquet | 267/127 |
| 3,229,496 | 1/1966 | Foster et al. | 72/429 |
| 4,638,731 | 1/1987 | Kato | 100/282 |
| 4,674,357 | 6/1987 | Sugawara et al. | 100/282 |

FOREIGN PATENT DOCUMENTS

| | | | |
|---|---|---|---|
| 518990 | 6/1921 | France | 72/452 |
| 3537560 | 9/1988 | Germany . | |
| 54-89683 | 6/1979 | Japan . | |
| 1479323 | 5/1989 | U.S.S.R. | 100/282 |

*Primary Examiner*—Stephen F. Gerrity
*Attorney, Agent, or Firm*—Harness, Dickey & Pierce, P.L.C.

[57] ABSTRACT

In a mechanical pressing machine, a flywheel is fixedly mounted on an input shaft, and a drive cam plate is fixedly mounted on the input shaft intermediate opposite ends thereof, and a torque compensation plate cam is mounted on the other end of the input shaft. A cam follower mounted on a distal end of a piston rod of a resilient force-producing device is held in pressing contact with the torque compensation plate cam so as to cancel a load fluctuation produced on the input shaft. The resilient force-producing device employs a compression coil spring or an air spring. With this construction, a periodic inertial load fluctuation, repeatedly produced for every revolution during the operation of the mechanical press, is compensated for by the system for reserving energy, and hence is canceled, thereby balancing the energy, so that variations in rotation of the input shaft are eliminated, thereby reducing vibrations and noises.

16 Claims, 6 Drawing Sheets

MECHANICAL PRESSING MACHINE HAVING A LOAD FLUCTUATING TORQUE CANCELLING DEVICE

BACKGROUND OF THE INVENTION

This invention relates to a mechanical pressing machine of the type in which a slider is reciprocally moved linearly relative to a frame through a plate cam.

In a mechanical pressing machine employing a plate cam, the plate cam is fixedly mounted on an input shaft to which power is transmitted from a motor through a flywheel, and a pair of upper and lower cam followers are mounted on a slider which is mounted on a frame for sliding movement in a vertical direction. A peripheral edge of the plate cam is held between the pair of cam followers, and with this arrangement a rotational motion of the plate cam is converted into a reciprocal linear motion of the slider. When imparting the reciprocal motion to the slider, an inertia load of the slider, an unbalanced load, a pressing load and so on give fluctuating load torques to the input shaft. When these fluctuating load torques increase, the input shaft may fail to rotate only by the drive torque of the motor. To avoid this, a flywheel has heretofore been attached to one end of the input shaft so that an abruptly-fluctuating load torque of the input shaft can be absorbed by an inertia force of the flywheel. With this arrangement, the maximum value of the input torque is alleviated, and therefore the machine can be operated by an output torque of the relatively small motor.

Recently, because of an increasing demand for a small-size, high-density design of electronic components and also for a clean environment, it has been desired to provide a high-performance mechanical pressing machine less noisy and highly precise. Reviewing pressing machines from this point of view, it will be appreciated that the currently-available mechanical pressing machines are so designed as to absorb all of the fluctuating loads by means of a flywheel. It is very rational and most desirable from the viewpoint of a mechanism to absorb an excessively large load fluctuation, produced instantaneously as in a pressing operation, by the inertia force of a large flywheel; however, although a constant load fluctuation, produced when imparting a reciprocal motion to the slider, can be ignored during a low-speed operation, its energy exceeds the energy of the pressing operation during a high-speed operation, so that the speed of rotation of the input shaft attached to the flywheel increases and decreases, and hence varies periodically for every revolution. It is known that such variations in rotation of the input drive system cause vibrations of the press and noises, and also adversely affect the durability of a clutch and a brake.

SUMMARY OF THE INVENTION

With the above problems of the prior art in view, it is an object of this invention to provide a mechanical pressing machine in which a periodic inertial load fluctuation, repeatedly produced for every revolution during the operation of a mechanical press, is compensated for by another system for reserving energy, and hence is canceled, thereby balancing the energy so that variations in rotation of an input shaft can be eliminated, thereby reducing vibrations and noises.

According to the present invention, there is provided a mechanical pressing machine comprising an input shaft having a flywheel mounted on one end thereof; a motor operatively connected to the input shaft for transmitting a rotational force of the motor to the input shaft; a slider; a drive plate cam fixedly mounted on the input shaft for rotation therewith; a cam follower for converting a rotational motion of the drive cam plate into a reciprocal linear motion of the slider; a torque compensation plate cam mounted on the other end of the input shaft for canceling a load fluctuating torque produced on the input shaft; a resilient force-producing device including a piston rod; and a cam follower mounted on a distal end of the piston rod and pressed against the torque compensation plate cam.

The resilient force-producing device employs either a compression coil spring mounted within a cylinder slidably receiving the piston rod, or gas sealed in the cylinder.

With the above construction of the present invention, a load fluctuating torque produced on the input shaft is canceled by the torque compensation plate cam, and therefore variations or irregularities in rotation of the input shaft are eliminated, so that vibrations and noises can be reduced.

DESCRIPTION OF THE PREFERRED EMBODIMENTS

Figure 1:
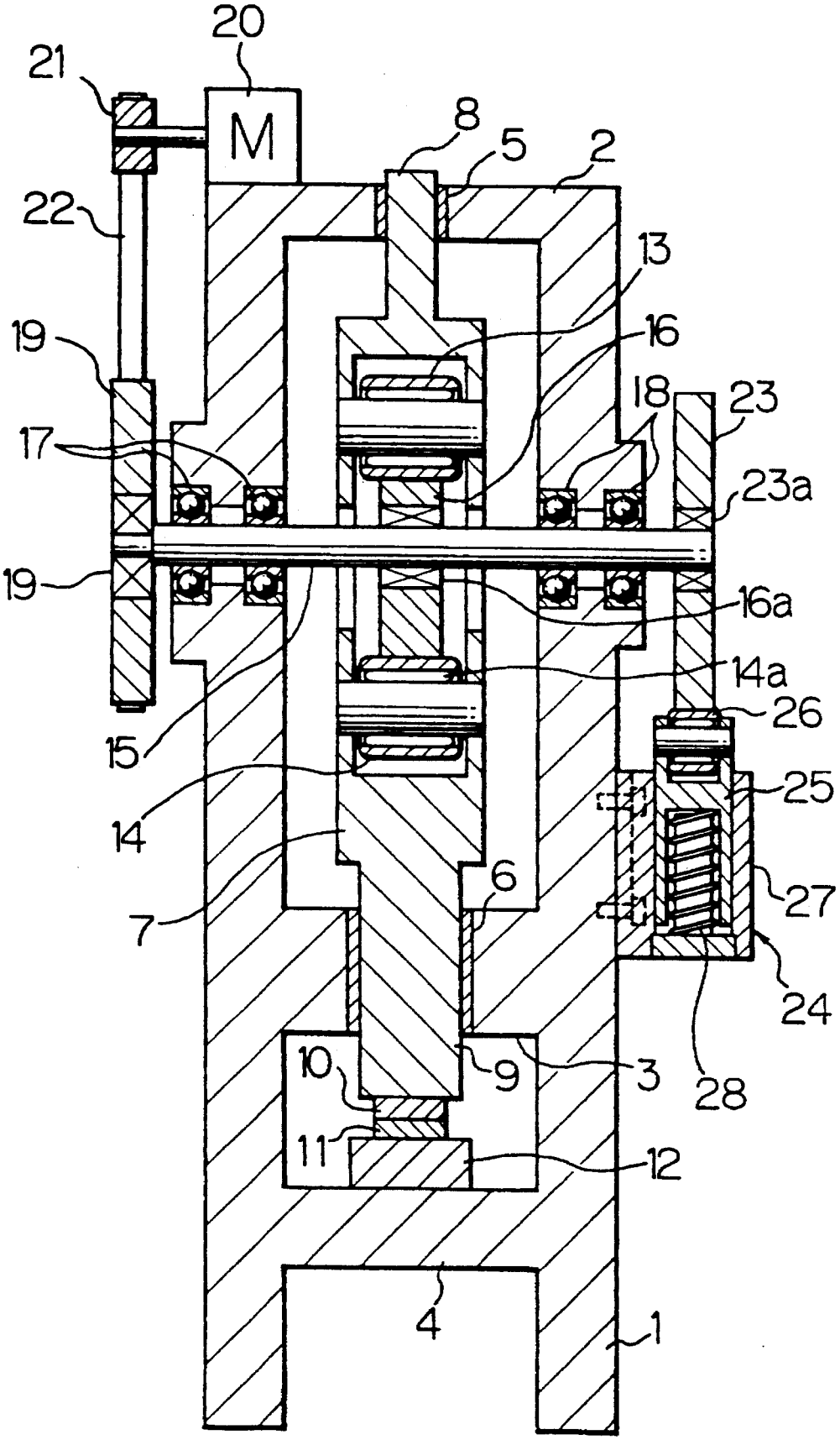
FIG. 1 is a schematic cross-sectional view of one preferred embodiment of a mechanical pressing machine of the present invention as viewed from a front side thereof.
Figure 2:
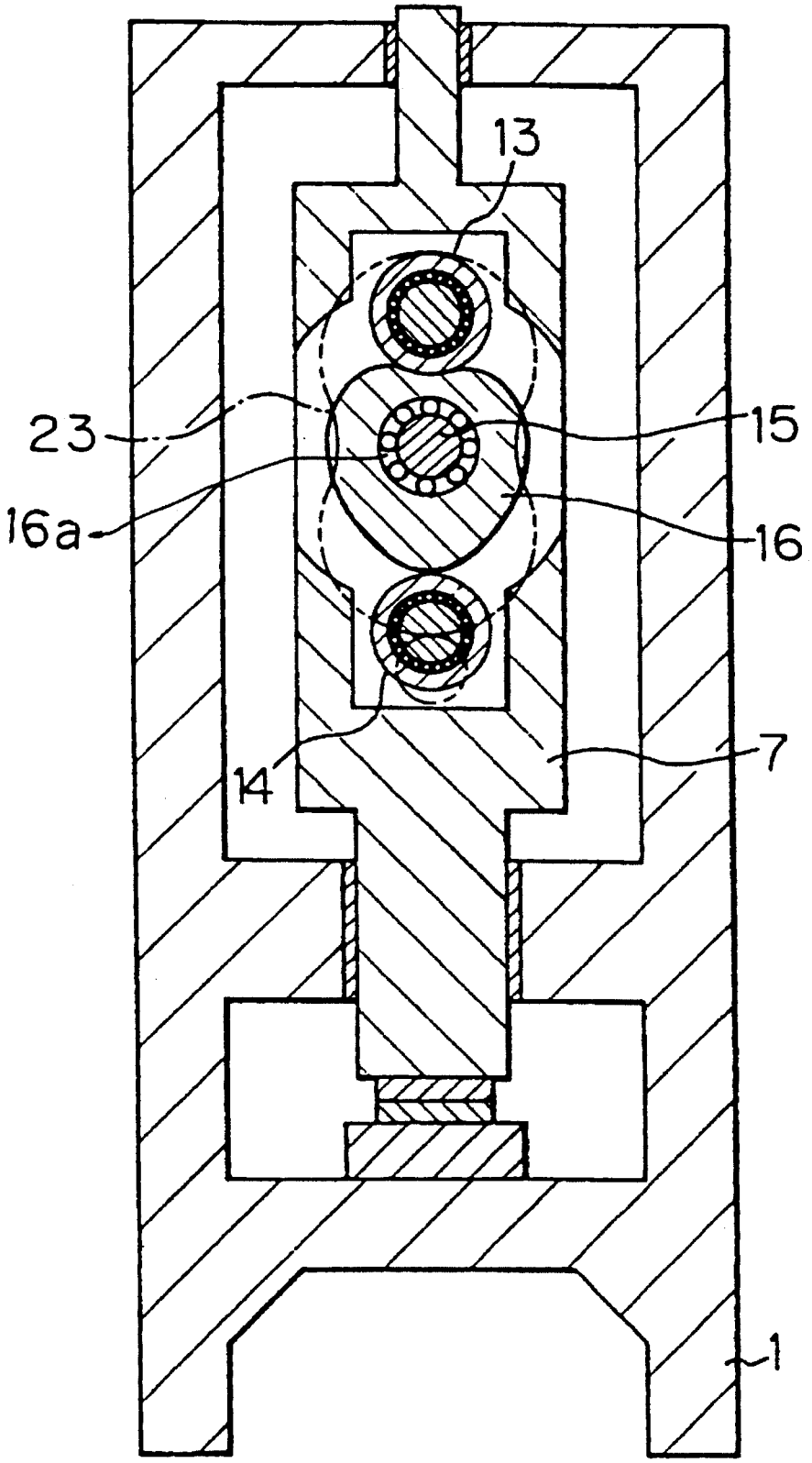
FIG. 2 is a schematic cross-sectional view of the pressing machine as viewed from a left side thereof.
Figure 3:
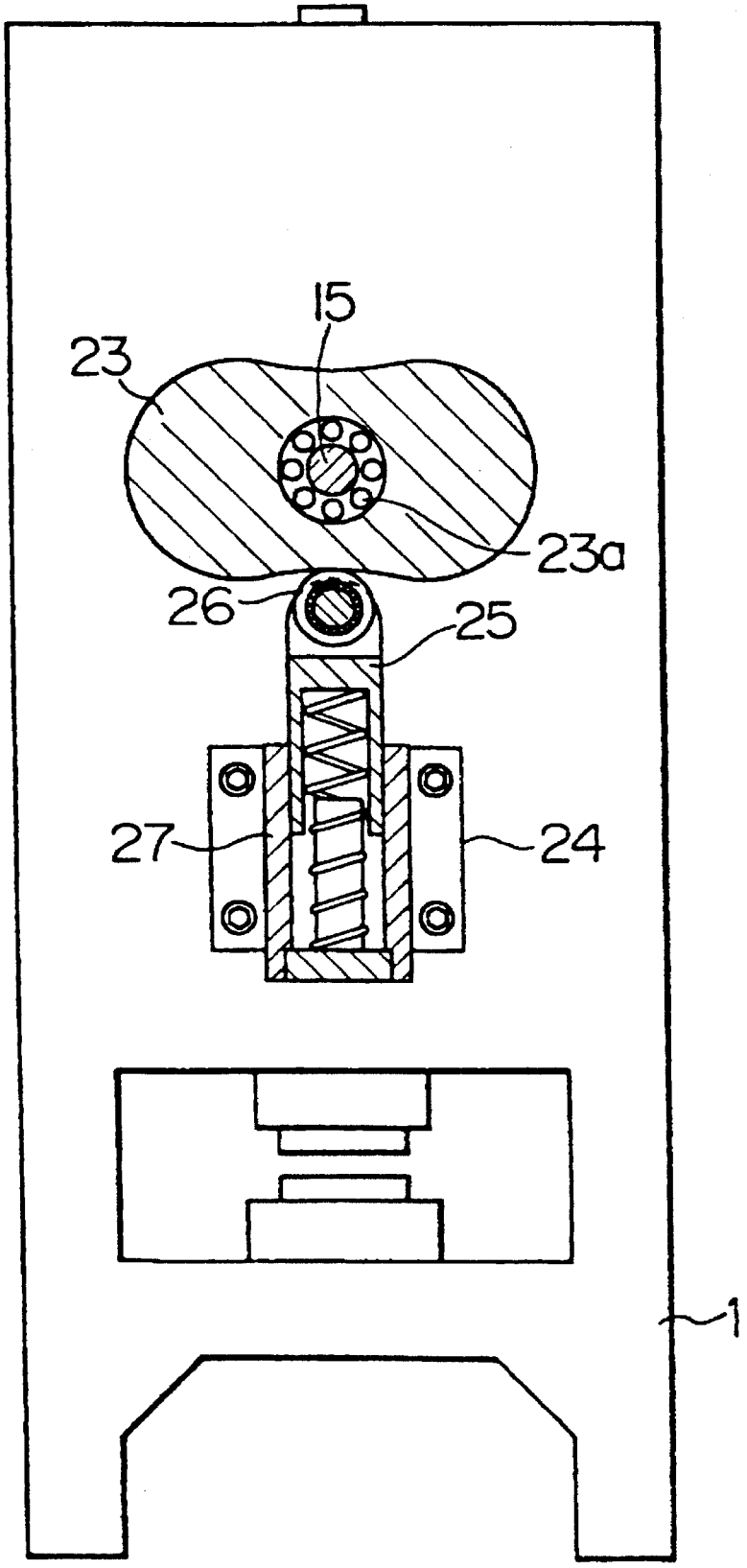
FIG. 3 is a schematic cross-sectional view of the pressing machine as viewed from a right side thereof.

FIG. 1 is a schematic cross-sectional view of one preferred embodiment of a mechanical pressing machine of the present invention as viewed from a front side thereof, FIG. 2 is a schematic cross-sectional view of the pressing machine as viewed from a left side thereof, and FIG. 3 is a schematic cross-sectional view of the pressing machine as viewed from a right side thereof. A frame 1 is of a box-shape, and includes an upper support portion 2, an intermediate support portion 3, and a lower support portion 4. A slider 7 is mounted on the upper and intermediate support portion 2 and 3 of the frame 1 through bearings 5 and 6 for sliding movement in a vertical direction, the bearings 5 and 6 supporting an upper guide portion 8 and a lower guide portion 9 of the slider 7, respectively. An upper die 10 is mounted on a lower end of the slider 7, and a lower die 11 is mounted on the lower support portion 4 of the frame 1 through a bolster 12.

A pair of upper and lower cam followers 13 and 14 are rotatably mounted on an intermediate portion of the slider 7, and an input shaft 15 extends horizontally through the slider 7 intermediate opposite ends thereof, and is passed between the pair of cam followers 13 and 14. A drive plate cam 16 of a heart-shape is fixedly mounted on the input shaft 15, and is held between the pair of cam followers 13 and 14. The input shaft 15 is rotatably mounted at its opposite end portions on the frame 1 through bearings 17 and 18. A flywheel 19 is fixedly mounted on one end of the input shaft 15 through a shaft fastening element 19a, and this flywheel 19 is driven for rotation through a belt 22 by a pulley 21 fixedly mounted on a rotation shaft of a motor 20 mounted on the upper support portion 2 of the frame 1. A torque compensation plate cam 23 in the form of an eccentric disk is fixedly mounted on the other end of the input shaft 15, and a cam follower 26 is rotatably mounted on a distal end of a piston rod 25 of a resilient force-producing device 24 fixedly mounted on a back plate of the frame 1. The cam follower 26 is held in pressing contact with the torque compensation plate cam 23. The resilient force-producing device 24 has a compression coil spring 28 mounted within a cylinder 27 slidably receiving the piston rod 25 therein, and the cam follower 26 is urged by the compression coil spring 28 into contact with a peripheral edge of the torque compensation plate cam 23. In the drawings, reference numerals 16*a* and 23*a* denote shaft fastening elements, respectively, and reference numeral 14*a* denotes a needle.

The operation of the above mechanical pressing machine will now be described. When the motor 20 rotates, and transmits its rotational force to the flywheel 19 via the pulley 21 and the belt 22 to rotate the input shaft 15, the slider 7 is reciprocally moved vertically through the drive cam 16 and the pair of cam followers 13 and 14, and a workpiece is worked between the upper and lower dies 10 and 11 mounted respectively on the slider 7 and the lower support portion 4 of the frame 1. On the other hand, the torque compensation plate cam 23, fixedly mounted on the other end of the input shaft 15, acts to cancel a load fluctuating torque produced on the input shaft 15 during the working of the workpiece by the reciprocal movement of the slider 7.

An inertia torque Ts, acting on the continuously-rotating input shaft 15 during the reciprocal movement of the slider 7, is proportional to the product of the acceleration A and velocity V of the slider 7 as follows where th represents the time required for a stroke of the slider 7.

$$Ts=I(Th^2/th^2/\theta h)A\cdot V$$

where I represents an inertia moment (kgf·m/s$^2$) of the slider, Th represents displacement (rad) of the slider, th represents time (s) required for rotation for Th, and θh represents an input shaft displacement (rad).

Figure 4:
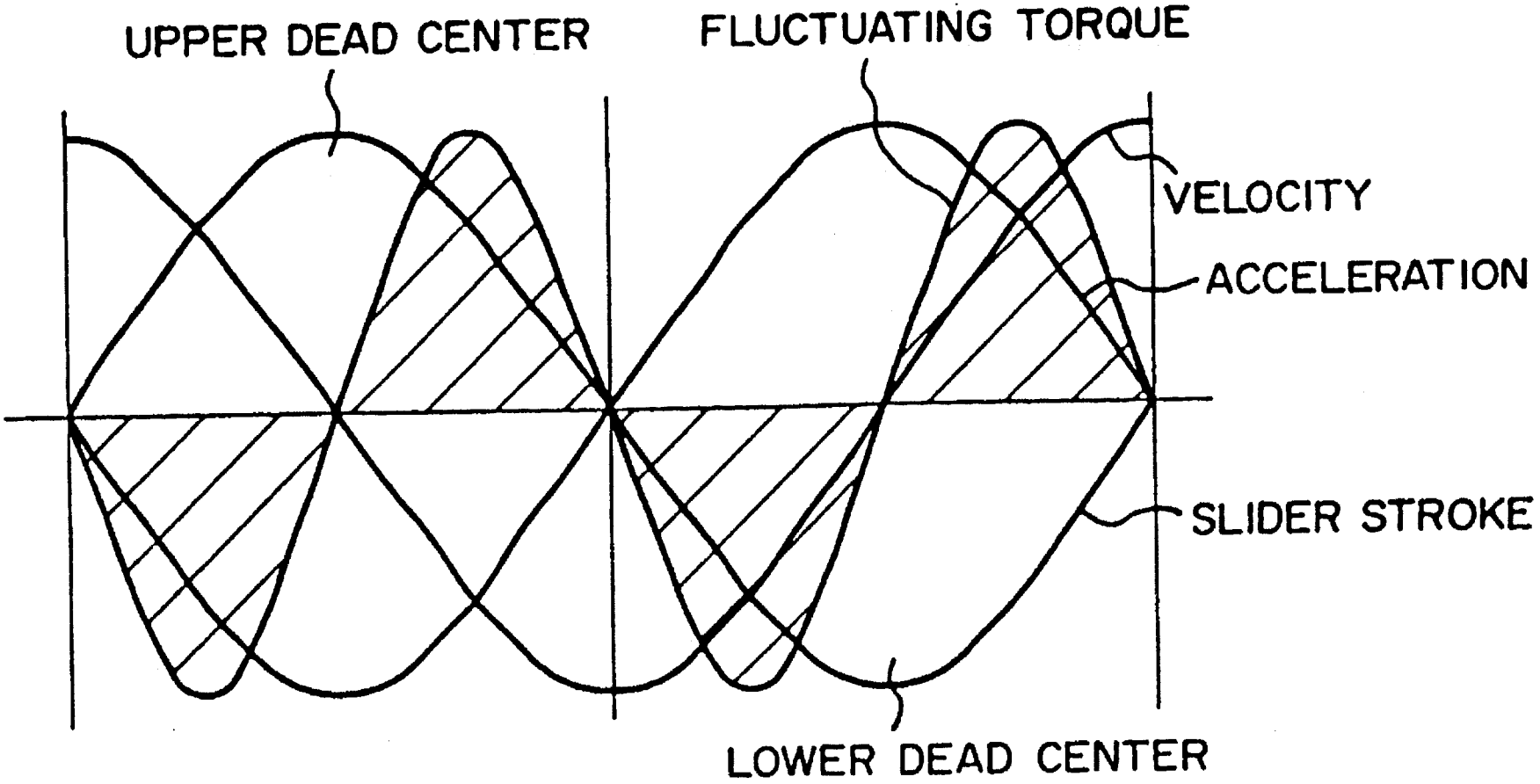
FIG. 4 is a graph showing the relation of a slider stroke with an acceleration and a velocity in the pressing machine of FIG. 1.

As will be appreciated from the above formula, Ts is proportional to A·V, and as indicated by hatching in FIG. 4, a negative torque is produced in the first half up to a lower dead center of the slider stroke S. A positive torque is produced in the second half from the lower dead center. With respect to an upper dead center, similarly, a negative torque is produced in the first half up to the upper dead center, and a positive torque is produced in the second half from the upper dead center. In order to cancel these torques, opposite torques relative to these torques are produced by the torque compensation plate cam 23 and the resilient force-producing device 24 so that the torque (energy) can be balanced over an entire range of one revolution of the input shaft 15.

Due to a spring constant F of the compression coil spring 28 of the resilient force-producing device 24, the torque Tk acting on the input shaft 15 is expressed by the following formula where y represents displacement of the torque compensation plate cam 23:

$$Tk=Fdy/d\theta=Fyth/\theta h$$

By solving the above formulas in such a manner that the sum of the torque Ts and the torque Tk becomes always zero (0), the contour of the torque compensation plate cam 23 can be found, and the load fluctuation of the input shaft 15 is canceled as described above, and therefore vibrations and noises are reduced, and the efficiency of the operation is improved, and an energy-saving effect can be expected.

Figure 5:
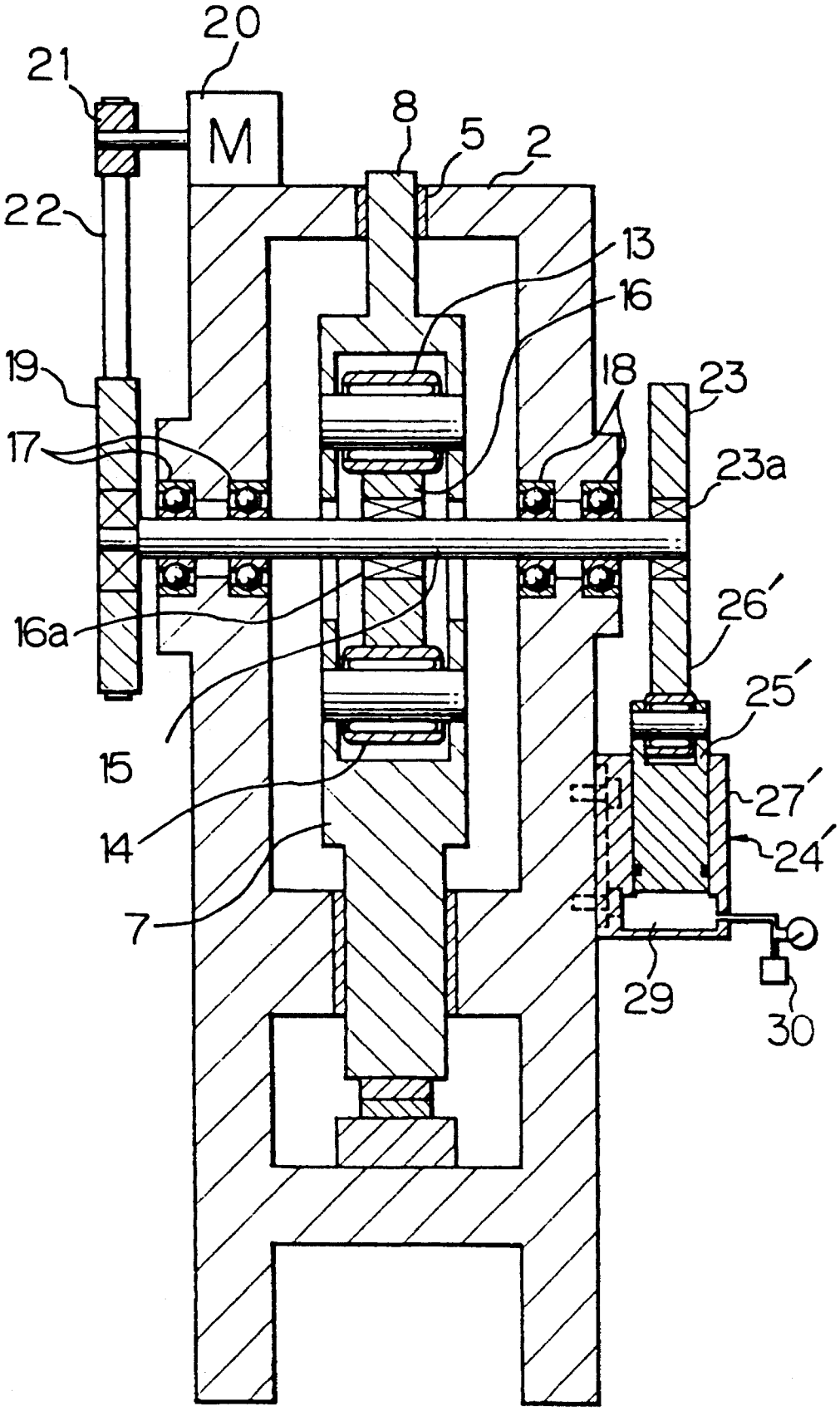
FIG. 5 is a schematic cross-sectional view of another preferred embodiment of a mechanical pressing machine of the invention as viewed from a front side thereof.
Figure 6:
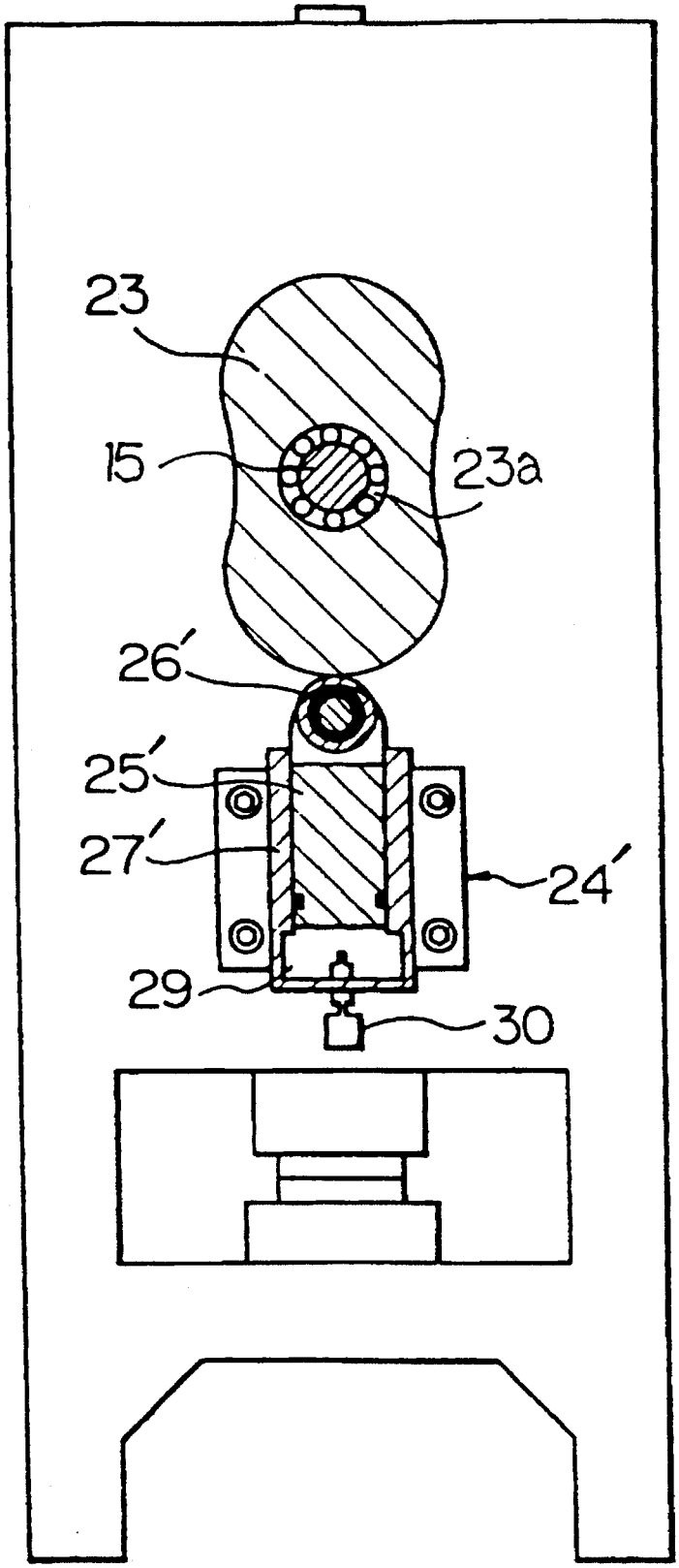
FIG. 6 is a schematic cross-sectional view of the mechanical pressing machine of FIG. 5 as viewed from a right side thereof.

FIG. 5 is a schematic cross-sectional view of another preferred embodiment of a mechanical pressing machine of the present invention as viewed from a front side thereof, and FIG. 6 is a schematic cross-sectional view of this pressing machine as viewed from a right side thereof. A left side-elevational view of this pressing machine is similar to that of FIG. 2. Although the resilient force-producing device 24 in the above pressing machine of the first embodiment employs the compression coil spring 28, an air spring is used in this embodiment. The other construction is the same as that of the first embodiment, and therefore those portions of this embodiment identical respectively to those of the first embodiment are designated by identical reference numerals, respectively, and explanation thereof will be omitted. Referring to FIGS. 5 and 6, in a resilient force-producing device 24', a cam follower 26' is rotatably mounted on a distal end of a piston rod 25', and the air 29 is sealed in a cylinder 27' slidably receiving the piston rod 25' therein. The sealed air 29 may be replaced by any other suitable gas. A pressure regulator 30 for adjusting the air pressure within the cylinder 27' is connected to the cylinder 27'.

In this embodiment, since the air spring is used as the resilient force-producing device, there is provided an advantage that by adjusting the air pressure within the cylinder 27' by the pressure regulator 30, a fine adjustment for torque compensation purposes can be easily effected.

As described above, in the present invention, the torque compensation plate cam is mounted on one end of the input shaft, and the cam follower mounted on the distal end of the piston rod of the resilient force-producing device is pressed against the torque compensation plate cam so as to cancel the load fluctuating torque produced on the input shaft. Therefore, variations or irregularities in rotation of the input shaft are eliminated to reduce vibrations and noises, and the efficiency of the operation is improved, and the energy-saving effect can be expected.

What is claimed is:

1. In a mechanical pressing machine comprising an input shaft having a flywheel mounted on one end thereof; a motor operatively connected to said input shaft for transmitting a rotational force of said motor to said input shaft; a slider having a linear reciprocal movement; a drive plate cam fixedly mounted on said input shaft for rotation therewith; and a cam follower on said slider for converting a rotational motion of said drive cam plate into a reciprocal linear motion of said slider;

the improvement comprising a torque compensation plate cam mounted on the other end of said input shaft for cancelling a load fluctuating torque produced on said input shaft during the entire rotation of the input shaft; a resilient force-producing device including a piston rod; and a cam follower mounted on a distal end of said piston rod and pressed against said torque compensation plate cam for cancelling the load fluctuating torque produced during the entire rotation of the said input shaft.

2. A mechanical pressing machine according to claim 1, in which said resilient force-producing device comprises a cylinder slidably receiving said piston rod therein, and a compression coil spring mounted within said cylinder to urge said piston rod.

3. A mechanical pressing machine according to claim 1, in which said resilient force-producing device comprises a cylinder slidably receiving said piston rod therein, gas being sealed within said cylinder to urge said piston rod.

4. The mechanical pressing machine according to claim 1 wherein a negative inertia torque is produced when the slider moves from the center of its reciprocal movement to the ends of its movement and a positive inertia torque is produced when the slider moves from the ends of its movement to the center of its reciprocal movement.

5. The mechanical pressing machine according to claim 1 wherein inertia torque acts on said input shaft during the reciprocal linear movement of said slider and an opposite torque is produced by the torque compensation plate cam in conjunction with the resilient force-producing device; the caming contour of the torque compensation plate cam formed so that the sum of the inertia torque and opposite torque is zero and the load fluctuation torque of the input shaft produced during rotation of the input shaft is cancelled.

6. A mechanical pressing machine comprising an input shaft having a flywheel mounted on one end thereof; a motor operatively connected to said input shaft for transmitting a rotational force of said motor to said input shaft; a slider having a linear reciprocal movement; a drive plate cam fixedly mounted on said input shaft for rotation therewith; and a drive plate cam follower on said slider for converting a rotational motion of said drive cam plate into a reciprocal linear motion of said slider; a torque compensation plate cam mounted on the other end of said input shaft for cancelling load fluctuating torque produced on said input shaft; a resilient force-producing device including a piston rod; a cam follower mounted on the distal end of said piston rod and pressed against said torque compensation plate cam, the torque compensation plate cam having a caming contour so that said torque compensation plate cam working in conjunction with the resilient force-producing device cancels the load fluctuating torque produced during the entire rotation of the input shaft.

7. A mechanical pressing machine according to claim 6 in which said resilient force-producing device comprises a cylinder slidably receiving said piston rod therein, and a compression coil spring mounted within said cylinder to urge said piston rod.

8. A mechanical pressing machine according to claim 6, in which said resilient force-producing device comprises a cylinder slidably receiving said piston rod therein, and gas being sealed within said cylinder to urge said piston rod.

9. A mechanical pressing machine according to claim 6, wherein a negative inertia torque is produced when the slider moves from the center of its reciprocal movement to the end of its movement and a positive inertia torque is produced when said slider moves from the ends of its movement to the center of its reciprocal movement.

10. A mechanical pressing machine according to claim 6 wherein the caming contour of the torque compensation plate cam is shaped so that the inertia torque produced during reciprocal movement of the slider is always cancelled out to zero by the torque acting on the input shaft by the torque compensation plate cam, cam follower, piston rod and resilient force-producing device.

11. The mechanical pressing machine according to claim 6 wherein inertia torque acts on said input shaft during the reciprocal linear movement of said slider and an opposite torque is produced by the torque compensation plate cam in conjunction with the resilient force-producing device; the caming contour of the torque compensation plate cam formed so that the sum of the inertia torque and opposite torque is zero and the load fluctuation torque of the input shaft produced during rotation of the input shaft is cancelled.

12. A method of cancelling the load fluctuation of a mechanical pressing machine comprising an input shaft having a flywheel mounted on one end thereof; a motor operatively connected to said input shaft for transmitting a rotational force of said motor to said input shaft; a slider having linear reciprocal movement; a drive plate cam fixedly mounted on said input shaft for rotation therewith; and a drive plate cam follower connected to said slider for converting a rotational motion of said drive cam plate into reciprocal linear motion of said slider; the method comprising mounting a torque compensation plate cam on the other end of said input shaft for entirely cancelling the load fluctuating torque produced on said input shaft; a resilient force-producing device including a piston rod; a cam follower mounted on the distal end of said piston rod and pressed against said torque compensation plate cam, the torque compensation plate cam having a caming contour so that said torque compensation plate cam in conjunction with said resilient force-producing device cancels the load fluctuating torque during the entire rotation of the input shaft.

13. The method according to claim 12, in which said resilient force-producing device comprises a cylinder slidably receiving said piston rod therein, and a compression coil spring mounted within said cylinder to urge said piston rod.

14. The method according to claim 12, in which said resilient force-producing device comprises a cylinder slidably receiving said piston rod therein, and gas being sealed within said cylinder to urge said piston rod.

15. The method according to claim 12 wherein a negative inertia torque is produced when the slider moves from the center of its reciprocal movement to the end of its movement and a positive inertia torque is produced when said slider moves from the ends of its movement to the center of its reciprocal movement.

16. The method according to claim 12 wherein an inertia torque acts upon said input shaft during the reciprocal linear stroke motion of said slider, an opposite torque is produced by the torque compensation plate in conjunction with resilient force-producing device, the caming contour of the torque compensation plate cam formed so that the sum of the inertia torque and opposite torque is zero and the load fluctuation of the input shaft produced during rotation of the input shaft is cancelled.

* * * * *